United States Patent [19]

Schmidt, Jr.

[11] 4,057,915

[45] Nov. 15, 1977

[54] RING STRUCTURE FOR PREVENTING BLADE DAMAGE

[75] Inventor: Alfred Schmidt, Jr., St. Blasien, Germany

[73] Assignee: Firma Ing. Alfred Schmidt GmbH, Schwarzwald, Germany

[21] Appl. No.: 558,953

[22] Filed: Mar. 17, 1975

[30] Foreign Application Priority Data

Mar. 30, 1974 Germany ..... 2415542

[51] Int. Cl.[2] ..... E01H 5/09

[52] U.S. Cl. ..... 37/43 C; 37/43 R; 416/195

[58] Field of Search ..... 37/43 R, 43 B, 43 C, 37/43 F, 43 G, 21, 43 E, 22, 23; 416/196 A, 195, 193, 62; 302/37, 43 R; 56/13.4

[56] References Cited

U.S. PATENT DOCUMENTS

| | | | |
|---|---|---|---|
| 142,260 | 8/1945 | Lee | 416/195 X |
| 486,062 | 11/1892 | Bangs | 416/193 |
| 489,008 | 1/1893 | Jacobs | 37/21 |
| 655,270 | 8/1900 | Perry | 416/193 |
| 1,247,263 | 11/1917 | Grindle | 416/193 |
| 1,341,653 | 6/1920 | Lee | 416/193 |
| 2,152,840 | 4/1939 | Drake | 37/43 B |
| 2,375,965 | 5/1945 | Turtle | 37/43 C |
| 2,732,638 | 1/1956 | Leufvenius | 37/43 B |
| 3,085,832 | 4/1963 | Guillemette | 37/43 B |
| 3,111,173 | 11/1963 | Klonoski | 416/195 |

FOREIGN PATENT DOCUMENTS

| | | | |
|---|---|---|---|
| 207,625 | 8/1955 | Australia | 416/193 |
| 415,724 | 10/1910 | France | 416/193 |
| 1,131,248 | 6/1962 | Germany | 37/43 B |
| 59,817 | 12/1939 | Norway | 37/43 C |
| 431,588 | 8/1967 | Switzerland | 37/43 E |

*Primary Examiner*—Edgar S. Burr
*Assistant Examiner*—Steven A. Bratlie

[57] ABSTRACT

In a centrifugal snow blower, a plurality of shovel-like blades are fixed on a shaft for rotation about its central axis. A ring or annular band is arranged concentrically about the central axis and is secured to the frontal cutting edges of each of the blades.

5 Claims, 2 Drawing Figures

RING STRUCTURE FOR PREVENTING BLADE DAMAGE

BACKGROUND OF THE INVENTION

The present invention relates to snow blowers and in particular to snow blowers adapted to be arranged with a plow as an attachment to a road service vehicle.

In general, snow blowers of the aforementioned type comprise a centrifugal fan formed by a cylindrically sectioned marginal wall in which a plurality of curved shovel-like blades are mounted to rotate on a central shaft. In practical operation of such rotary blowers, it has been found that blades are subject to considerable wear. This problem applies particularly to such snow blowers which are arranged laterally or to the side of a plow which is adapted to collect and feed the snow to the fan. Foreign bodies such as stones, wood and road trash are often caught by the plow and fed to the blades resulting in serious damage to the blades. It has been observed that such damage occurs mainly to the radial external zones of the frontal cutting edges of the blades.

It is the object of the present invention to provide an improved snow blower in which the defect and disadvantages of the prior art devices is overcome.

It is another object of the present invention to provide a snow blower in which the wear of the shovel-like blades is greatly reduced and thus to provide a snow blower having a longer operating life.

It is a specific object of the present invention to provide a snow blower in which foreign bodies are prevented from entering into the interior of the centrifugal fan.

The foregoing objects together with other objects and advantages will be obvious, from the following disclosure of the present invention.

SUMMARY OF THE PRESENT INVENTION

According to the present invention a snow blower is provided in which a plurality of shovel-like blades are mounted on a shaft for rotation about its central axis. One or more rings or annular metal bands, arranged concentrically about the central axis, are secured to the front of the blades.

Preferably the rings are welded to the frontal cutting edges of each of the blades, axially projecting from said cutting edges, and have a diameter greater than half the radius of the centrifugal fan itself. In some embodiments axially projecting lugs can be attached to the ring. Such lugs may be welded at the point of weldment of the ring to the blades.

Full details of the present invention are set forth in the following disclosure of one preferred form of the present invention and are shown in the accompanying drawing.

DESCRIPTION OF THE PRESENT INVENTION

Figure 1:
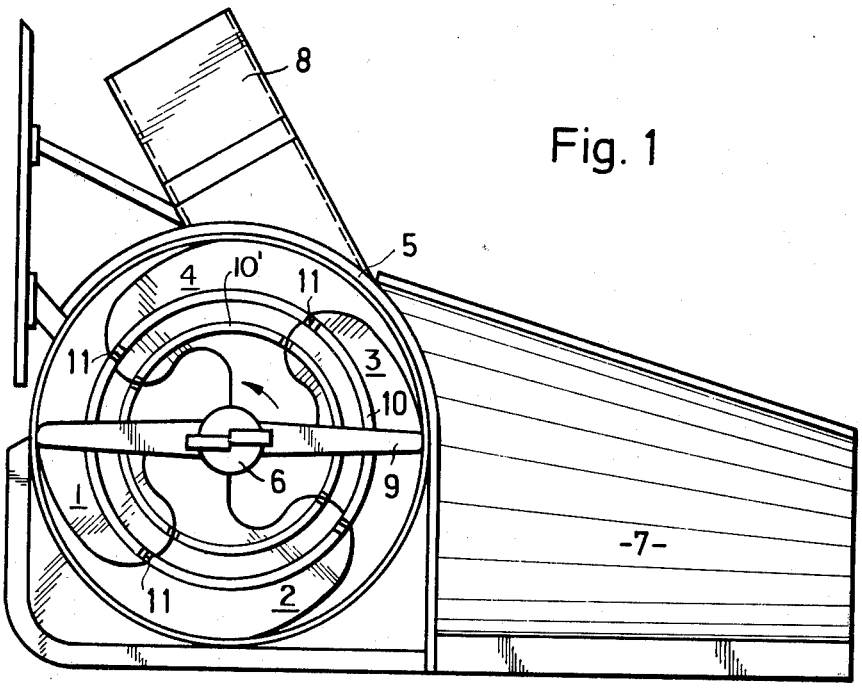
FIG. 1, is a front elevational view of a snow blower and plow embodying the present invention.

In the drawing, a snow blower is shown which is adapted to be linked or attached to a service vehicle such as a truck or tractor, in conventional manner, so as to be pushed or dragged along the road. The blower consists of a suitable frame having a horizontal lower edge on which a centrifugal fan is mounted. The fan has a plurality of blades of which four, numbered 1, 2, 3 and 4, are shown surrounded by a cylindrically sectioned housing 5 having an opening at its top. The blades 1, 2, 3 and 4 are suitably curved to form a scoop or shovel. The design of the blades is conventional and usual, having a compound curve, the front edges of which act to cut into the snow as the blades are notated. The blades 1, 2, 3 and 4 are jointly fixed on a central hub shaft 6 which is rotatable in the direction indicated by the arrow, about its own central axis. The apparatus may be provided with its own motor drive means which is connected to the shaft 6 to rotate the fan or it may be provided with suitable transmission means which connects the shaft to a remote drive. In any event, the shovel-like blades 1, 2, 3 and 4 centrifugally cut into and hurl the snow in a tangential path through the opening in the housing 5.

An elongated plow 7 extends laterally and angularly from one side of the housing 5, to collect the snow and feed the same into the interior of the centrifugal fan. Extending angularly above the housing 5 and in line with the ejection hole formed therein, is a discharge pipe 8 through which the snow may be hurled in a given direction.

A propellor 9, of generally linear shape is attached at its center to the hub of the shaft 6, axially in front of the blades 1, 2, 3 and 4. The propellor acts to precut any hard snow or ice clumps which may accumulate in front of the blades so that such snow can be handled more easily by the fan.

A ring 10, or annular band, of suitable metal is arranged concentrically about the shaft 6, and is welded to the front of each of the blades about $\frac{2}{3}$ of the radial distance between the central axis and the housing 5. The diameter of the ring 10 should be greater than the radius of the fan and preferably within the range of 70 to 90% of the diameter of the fan so that the weld falls within the region of the forward or frontal cutting edge of the blades generally behind the forward most point of the cutting edge of the blades. The ring 10 further protrudes in front of the cutting edge of the blade and is freely spaced relative to the remaining portion of the blade face thus allowing movement of the snow therethrough.

A lug 11 is secured, as by welding, at the point of attachment of the ring 10 to each of the blades. The lug 11 extends axially in front of the ring 10 and serves to reduce the frontal resistance of the ring to the loading of the snow. The lug 11 may be secured to the ring at the points other than the attachment points between the ring and the blades. Also more than four lugs may be provided.

As illustrated in the drawing, it will be obvious that a plurality of such rings as indicated by 10 and 10' may be welded to the front edges of the fan blades concentrically spaced about the central axis. Experiments have shown that the arrangement of only one ring is quite adequate to provide the objects and advantages of the present invention and to avoid a substantially and significantly lowered resistance at the frontal end of the blower to the movement of snow. The ring, or rings if they are used, are made of steel or other metal, of the same type from which the shovel-like blades themselves are made. Other metals, steels etc. may be used. Preferably, the rings are welded to the front edges of the blades to form a unitary solid rigid and strong construction. Other means for securing the rings to the blades may also be used with the same object in mind. In a conventional centrifugal fan, four blades are employed. The ring may therefore be attached at four points and by arranging the diameter of the ring to be at least about $\frac{2}{3}$ of the radius of the fan itself, the ring is arranged behind the point of the front cutting edge of the blades at which the blades first cut into the snow. Thus, the ring does not normally interfer with the cutting operation of the blades. However, the arrangement of the ring, as shown above, largely avoids damage to the blades themselves and to the inner driving parts of the centrifugal fan. Having in mind that damages occur mainly to the radial external zones of the blades, the penetration of particularly large foreign bodies, other than snow is, for all practical purposes, prevented by the ring.

Figure 2:
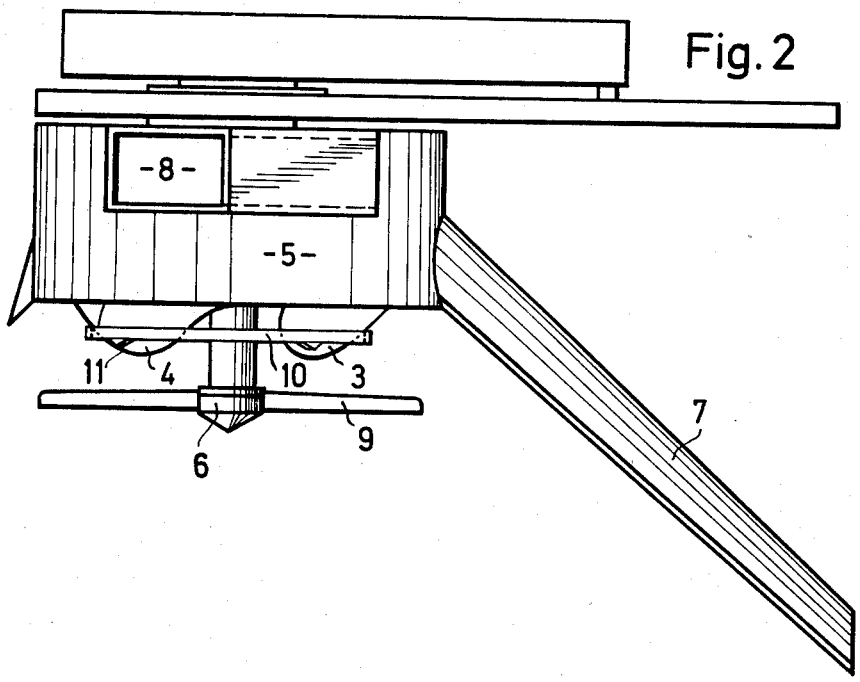
FIG. 2, is a plan view of the snow blower shown in FIG. 1.

A further advantage of the present invention arises from the fact that the position of the ring as seen in FIG. 2 tends to prevent the blades from cutting into the shoulders or curbs of the road, which as is frequently observed in the use of the prior art devices leads to considerable damage to the blades. Such damage is avoided by the present invention since the ring protrudes laterally as well as axially from the curved blade. In addition to reducing wear on the blades, the ring provides effective reinforcement of the rotor or rotational parts of the centrifugal fan. The fan, as is well known, rotates at such a speed, so as to impell the snow. In this condition the impeller fan is normally susceptible to damage. Further, the ring also intends to prevent the centrifugal casting of foreign bodies, stone, wood or the like, thus minimizing the ejection of such foreign bodies from the snow blower preventing damage or injury to persons or property.

From the foregoing it will be obvious with various changes modifications may be made to the present invention without departing from the concept thereof. It is accordingly intended that the present disclosure be taken as a illustrative only of the present invention and not as limiting of its scope.

What is claimed is:

1. A centrifugal snow blower for clearing snow fall comprising a housing defining an opening in the direction of clearing, a fan rotatable about a central axis arranged within said housing, said fan comprising a rotatable shaft having a plurality of curved scoop-like blades, each of which has one end attached to said shaft, each of said blades extending radially from and axially of said shaft to protrude axially through said opening and at least in part out of said housing, said blades each terminating in a rounded leading or cutting edge with the forwardmost extent of each blade being located in a common plane outside said housing and perpendicular to the shaft, and means for preventing introduction of obstacles into said housing and damage to said blades comprising a ring concentric to the central axis of said fan welded to said rounded leading or cutting edges between their forwardmost extent and the front of said housing.

2. The snow blower according to claim 1 including a plurality of rings arranged about said central axis.

3. The snow blower according to claim 1 wherein the diameter of the ring is greater than the radius of the fan.

4. The snow blower according to claim 1 wherein the radius of the ring is at least $\frac{2}{3}$ the radius of the fan.

5. A centrifugal snow blower according to claim 1, including a lug attached to selected ones of the points at which said ring and fan are welded, said lug protruding axially from said ring.

* * * * *